US005465041A

United States Patent [19]

Sanders et al.

[11] Patent Number: 5,465,041

[45] Date of Patent: Nov. 7, 1995

[54] BIPOLAR TRACKING CURRENT SOURCE/SINK WITH GROUND CLAMP

[75] Inventors: Gary G. Sanders, Rock Falls; John R. Kessinger, Polo, both of, Ill.

[73] Assignee: Penberthy, Inc., Prophetstown, Ill.

[21] Appl. No.: 122,212

[22] Filed: Sep. 17, 1993

[51] Int. Cl.[6] ..... G05F 3/08; G05F 3/14

[52] U.S. Cl. ..... 323/312; 323/317

[58] Field of Search ..... 323/312, 315, 323/316, 317

[56] References Cited

U.S. PATENT DOCUMENTS 4,451,779 5/1984 Griep ..... 323/312

5,153,499 10/1992 Klesh ..... 323/280

5,381,082 1/1995 Schlicht ..... 323/312

*Primary Examiner*—Peter S. Wong

*Attorney, Agent, or Firm*—Jenner & Block

[57] ABSTRACT

A system for controlling a bipolar constant current when the current is being supplied to an active or reactive element. Tracking is extended to either sink or source modes. A switchable driven ground state is also provided. An operational amplifier buffer senses the voltage amplitude at the junction of the system output and active or reactive load element. This relatively low impedance output is summed or offset with a regulated voltage. This level is again buffered to present a low output impedance and series connected with a current limiting resistor.

15 Claims, 1 Drawing Sheet

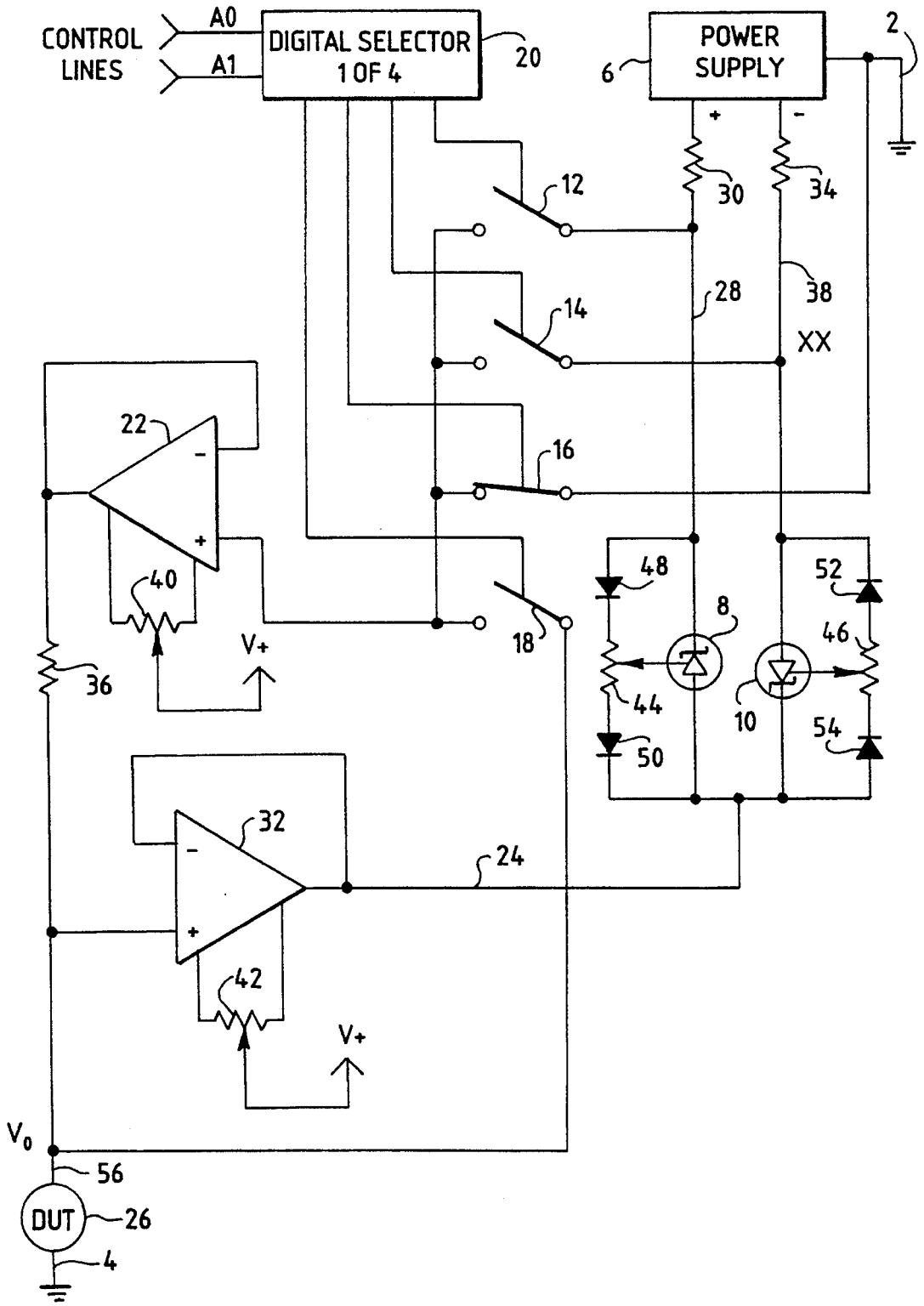
CONTROL LINES
A0
A1
DIGITAL SELECTOR 1 OF 4
20
POWER SUPPLY
6
2
12
14
16
18
30
34
28
38
XX
22
40
V+
36
48
52
8
46
44
10
50
54
32
24
42
V+
$V_0$
56
DUT
26
4

BIPOLAR TRACKING CURRENT SOURCE/SINK WITH GROUND CLAMP

BACKGROUND OF THE INVENTION

The invention relates to a current source and sink, and more particularly to a precision tracking, switchable bipolar current source/sink with ground clamping (zeroing) at the discrete circuit level.

A variety of constant current devices and circuits are known in the art. The fundamental textbook constant current circuit is a constant voltage source series connected to a load through a high impedance (usually resistive) device. This type of device has several limitations. It generally requires high voltages with high power dissipation in the resistor. Also, the current is not readily programmable or controllable over a range by means of another voltage. To overcome these problems, transistors may be used, taking advantage of the base-emitter voltage ($V_{be}$) match of two or more bipolar transistors (e.g., current mirrors, Wilson mirrors and extensions) or the pinch mode operation of field effect transistors (FET's). These implementations are programmable and fairly compliant, but are practical only when used on an integrated circuit where transistor characteristics can be closely matched.

One discrete device solution is the constant current diode, which is essentially a FET with its gate tied to source or a pair of cross-coupled FET's. Another very practical, adjustable, compliant and often-used current sink places the base-emitter junction of a transistor into the feedback loop of a operational amplifier. Unfortunately, tight regulation at low current usage is poorly controlled due to operation near cut-off. Errors are especially noted with thermal variations.

Currently, common current sources and sinks use the variable impedance of an active semiconductor device in conjunction with a fixed voltage to vary the output current depending on load conditions in an effort to stabilize the current to some preset value. However, since semiconductor impedance devices of the type described are polarity sensitive, these devices may act as current sources or sinks, but not both.

SUMMARY OF THE INVENTION

The present invention provides a highly complaint, switchable current source and sink, with clamping and zeroing, using discrete components. The invention uses electronic circuitry to sense the voltage of a circuit point, sum this voltage with a reference voltage and supply the resultant potential through a resistor. This sets the current sink/source value by Ohm's Law as the reference voltage divided by the series resistance, independent of the state, amplitude or dynamic condition of the sensed voltage. This device differs from previous devices in that rather than using a dynamic impedance device, a variable voltage with fixed resistance is used. The external control required is a digital type signal to determine the form of current flow desired, i.e., sink, source or zero.

The invention provides a current source which is particularly useful in integrators, saw tooth generators and ramp generators, which generally require a capacitor to be charged at a constant current; i.e., linearly. The invention is thus particularly useful in a capacitance measuring circuit relying on linear charging such as that disclosed in co-pending application entitled Capacitance Measuring Device, Ser. No. 08/123,316, filed Sep. 17, 1993. The invention is also useful in other applications such as instrumentation which requires active loading for high gain and differential pair drivers used as an active load or active sink or source. The circuit of the invention is accurate even at very low current flows, and is highly compliant with minimized inaccuracies caused by thermal effects.

DESCRIPTION OF THE DRAWING

FIG. 1 is a block diagram of a fully implemented bipolar and zeroing current source/sink with clamping that tracks a sensed voltage with a high degree of compliance with minimized inaccuracies caused by thermal effects.

DESCRIPTION OF THE PREFERRED EMBODIMENT

The preferred embodiment of the invention shown in FIG. 1 is a tracking, switchable source/sink/zeroing current device. Obviously, if only sinking and/or sourcing (with or without zeroing) is desired, then portions of the switching elements and other circuit parts may be eliminated. With reference to FIG. 1, note that points 2,4 represent the same isopotential level, herein termed circuit common (ground).

A bipolar voltage supply 6 generates reference voltage levels when connected to bandgap reference devices 8,10. These reference voltages are connected through two analog switches 12,14, one switch 12 for the positive reference and one switch 14 for the negative reference. Two other analog switches 16,18 connect directly to circuit common (ground) and reactive load sense, respectively. External digital control lines A0,A1 activate one, and only one, analog switch at a time by means of a one-of-four type digital selector 20.

To initialize with a forced ground condition to equalize all circuit points, analog switch 16 is activated (closed) by setting the digital selector address lines A0 and A1 both low. This presents ground potential to the input of buffer amp 22. The output of buffer amp 22 then clamps the circuit output/sense point 24 to ground potential. Using a capacitor as an example device under test (DUT) 26, both plates are held at the same potential (arbitrarily ground), and there is no net charge on capacitor 26. This zeroing or nulling action is not tracking, but is intended only for system initialization and/or ground clamping the output.

The method of establishing the potential at positive reference point 28 is as follows. The positive output of voltage source 6 is connected through series resistor 30 creating the bias requirements for bandgap reference device 8. Since bandgap reference device 8 is not returned to circuit common, its reference side is offset by the potential established at point 24 by the low impedance output of buffer amp 32 which tracks the amplitude of the output $V_o$. Thus as charge accumulates on capacitor 26, the voltage $V_o$ increases, the offset buffered by operational amplifier 32 increases and the potential established at positive reference point 28 increases as the algebraic sum of the output of buffer 32 and bandgap reference device 8. This point remains a constant bandgap reference above $V_o$. If polarities are reversed, using the negative output of power supply 6, series resistor 34 and bandgap reference device 10, the same scenario is followed with polarity reversal, with negative reference point 38 remaining a constant bandgap reference below $V_o$.

Current sourcing occurs when the address lines to digital selector 20 are set A0=high and A1=low. This will activate analog switch 12 which is tapped at the voltage potential at positive reference point 28. This becomes the input to buffer amp 22 whose output is series connected through the current setting resistor 36 thence to the output. This arrangement allows the bandgap reference to remain at a constant level above the accumulated charge on test capacitor 26, thus maintaining a constant voltage difference across current setting resistor 36. Since I=VR and the voltage tracks, i.e., remains constant across R, then I must remain at a constant flow.

Current sinking occurs when the address lines to digital selector 20 are set A0=low and A1=high. This will activate analog switch 14 which is tapped at the voltage potential at negative reference point 38. This becomes the input to buffer amp 22 whose output is series connected through current setting resistor 36 thence to the output. This arrangement allows the bandgap reference to remain at a constant level above the accumulated charge on test capacitor 26, thus maintaining a constant voltage difference across current setting resistor 36. Again, since I=VR and the voltage tracks, i.e., remains constant across R, then I must remain at a constant flow.

The maximum amount of current that may be sourced (or "sunk") is a function of the value of current setting resistor 36 and the output impedance of operational amplifier 22, as expressed by $I_o=V_{ZD}/R_{Iset}$.

Although the foregoing example uses a capacitor as the reactive load, the circuit tracks in a similar manner for dynamic loading such as differential amplifiers, dynamic $Z_L$ loading of transistors, etc. A prime consideration when used for these types of service is the bandwidth of the device, which is largely a function of the type of operational amplifier used.

System errors are reduced by using offset trimming potentiometers 40,42 on each of buffer amps 22,32, respectively. Also, both bandgap devices 8,10 are resistively trimmed using potentiometers 44,46 and have temperature compensation diodes 48, 50, 52, 54 series-connected on both sides of adjustment potentiometers 44,46.

Switching bandgap devices 8,10 is necessary to prevent reverse current since these devices are not blocking diodes and will be destroyed by sufficient reverse current. Of course, manual switches could be used, but typically the switching will be under digital control as described above. In the alternative, series blocking diodes may be used to protect bandgap reference devices 8,10, but with an accuracy penalty. If offsets larger than those generated by bandgap references are desired, zener diodes or operational amplifier multiplying stages may be substituted.

For less elegant systems, instead of buffer amp 22 a summing junction operational amplifier circuit may be substituted. For even less demanding service, the bandgap devices may be replaced by simple signal diodes, although thermal tracking suffers due to the temperature dependance of current/voltage characteristics of a diode by:

$$I=I_o(e^{qV/kT}-1)$$

where:

q=electron charge

V=voltage k=Boltzmann's constant=$8.6\times10^{-5}$ eV/K

T=temperature in °K.

A holding/clamping circuit may be added by activating analog switch 18 by setting the digital selector address lines A0 and A1 both high. This shunts bandgap reference devices 8,10. Assuming a capacitive reactive load at the output junction, this tends to clamp or hold the sensed voltage at output reference point 56 against droop. The quality and duration of this form of clamping is primarily dependent upon the quality of the capacitor used and any operational amplifier offsets. This feature provides feedback without any offset, and can be used for sample-and-hold applications.

The exact choice of components will vary with the desired current and accuracy, but as an example, for a 12 V, 100 μA supply (source or sink), the following components may be used:

Voltage of supply 6=±12 Vdc

Resistors 30,34=10 KΩ

Operational amplifiers 22,32=LM310

Bandgap references 8,10=LM136 / 2.5 V

Diodes 48,50,58,54=1N4148

Digital Selector 20=CD4514BC

Potentiometers 44,46=10 KΩ

Potentiometers 40,42=10 KΩ

Resistor 36=25 KΩ for 100 μA source or sink

While the present invention has been described with respect to specific embodiments thereof, it will be understood that various changes and modifications will be suggested to one skilled in the art and it is intended that the invention encompass such changes and modifications as fall within the scope of the appended claims.

We claim:

1. A tracking current source comprising:

sensing means for sensing the voltage of a circuit point;

reference means for generating a reference voltage;

summing means for summing said sensed voltage with said reference voltage; and means for supplying said summed voltage through a resistor to a load.

2. The current source of claim 1 wherein said sensing means comprises a buffer amplifier.

3. The current source of claim 1 wherein said summing means comprises a buffer amplifier.

4. The current source of claim 1 wherein said summing means comprises an operational amplifier summing junction.

5. The current source of claim 1 wherein said reference means comprises a voltage supply and at least one voltage regulating device.

6. The current source of claim 5 wherein said voltage supply is a bipolar voltage supply.

7. The current source of claim 6 further comprising a voltage regulating device connected to each of the positive and negative polarity outputs of said bipolar voltage supply.

8. The current source of claim 5 wherein said voltage regulating device is a bandgap device.

9. The current source of claim 5 wherein said voltage regulating device is a signal diode.

10. The current source of claim 1 further comprising means for zeroing the current to said load.

11. A switchable, bipolar tracking constant current supply comprising:

a bipolar voltage supply;

switching means for selecting one of each of the polarity outputs of said voltage supply;

reference means for generating a reference voltage;

sensing means for sensing the voltage of a circuit point;

summing means for summing said sensed voltage with said reference voltage; and means for supplying said summed voltage through a resistor to a load.

12. The current supply of claim 11 wherein said switching means comprises a digital selector and at least two analog switches.

13. The current supply of claim 12 wherein said reference means comprises a pair of voltage regulating devices, each of said voltage regulating devices being selectively connected to one of said outputs of said voltage supply.

14. The current supply of claim 11 further comprising means for zeroing the current to said load.

15. The current supply of claim 11 further comprising means for clamping said sensed voltage.

* * * * *